US010531201B2

(12) United States Patent
Zhang

(10) Patent No.: US 10,531,201 B2
(45) Date of Patent: Jan. 7, 2020

(54) ACOUSTIC DEVICE

(71) Applicant: AAC Technologies Pte. Ltd., Singapore (SG)

(72) Inventor: Ning Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/233,434

(22) Filed: Dec. 27, 2018

(65) Prior Publication Data

US 2019/0238987 A1 Aug. 1, 2019

(30) Foreign Application Priority Data

Jan. 27, 2018 (CN) ..... 2018 1 0079979

(51) Int. Cl.

| | |
|---|---|
| ***H04R 9/04*** | (2006.01) |
| ***H04R 1/02*** | (2006.01) |
| ***H04R 1/28*** | (2006.01) |
| ***H04R 9/02*** | (2006.01) |
| ***H04R 9/06*** | (2006.01) |
| ***H04R 1/06*** | (2006.01) |
| *H04R 31/00* | (2006.01) |

(52) U.S. Cl.

CPC ..... *H04R 9/046* (2013.01); *H04R 1/02* (2013.01); *H04R 1/06* (2013.01); *H04R 1/2803* (2013.01); *H04R 1/2811* (2013.01); *H04R 9/025* (2013.01); *H04R 9/06* (2013.01); *H04R 31/006* (2013.01); *H04R 2499/11* (2013.01)

(58) Field of Classification Search

CPC ..... H04R 9/046; H04R 9/06; H04R 9/025; H04R 1/06; H04R 1/2811; H04R 1/2803; H04R 1/02; H04R 31/006; H04R 2499/11; H04R 2400/11

See application file for complete search history.

(56) References Cited

U.S. PATENT DOCUMENTS

| | | | | |
|---|---|---|---|---|
| 2011/0075880 A1* | 3/2011 | Kamimura | ..... | H04R 1/06 381/413 |
| 2011/0123061 A1* | 5/2011 | Kamimura | ..... | H04R 9/025 381/412 |
| 2013/0133975 A1* | 5/2013 | Kim | ..... | H04R 7/16 181/166 |
| 2013/0156237 A1* | 6/2013 | Kim | ..... | H04R 9/06 381/191 |

* cited by examiner

*Primary Examiner* — Tuan D Nguyen

(74) *Attorney, Agent, or Firm* — IPro, PLLC; Na Xu

(57) ABSTRACT

The present disclosure provides an acoustic device. A vibrating diaphragm includes an edge and a damper for fixing and supporting the edge, where the damper includes a middle dome and a circuit board for fixing and supporting the middle dome, the fixing part of the circuit board is provided with a conductive part electrically connected to a voice coil lead; and an orthographic projection of the middle dome on the circuit board is not overlapped with the conductive part. The orthographic projection of the middle dome of the acoustic device on the circuit board is not overlapped with the conductive part during spot welding between the circuit board and the voice coil, therefore the problem of a short circuit of an aluminum foil dome caused by the fact that the circuit board is broken down due to overhigh spot welding temperature and pressure can be avoided.

10 Claims, 5 Drawing Sheets

ACOUSTIC DEVICE

CROSS-REFERENCE TO RELATED APPLICATIONS

This application claims the priority benefit of Chinese Patent Applications Ser. No. 201810079979.4 filed on Jan. 27, 2018, the entire content of which is incorporated herein by reference.

TECHNICAL FIELD

The present disclosure relates to the field of electro-acoustic transduction, and in particular, to an acoustic device.

BACKGROUND

A general acoustic device includes a magnetic circuit system and a vibration system, the vibration system includes a voice coil and a vibrating diaphragm that are connected to each other, and the electrified voice coil drives the vibrating diaphragm to vibrate under the action of the magnetic circuit system so as to produce a sound.

A terminal of a flexible printed circuit board (FPC board) is in communication with the voice coil after being welded to the voice coil by using a spot welding process so as to supply power to the voice coil.

The vibrating diaphragm serving as a core part of the acoustic device such as a speaker has great influence on performance of the acoustic device. The vibrating diaphragm in the related art is a dome-type vibrating diaphragm, and the dome is made of an aluminum foil material. In a mass production process of acoustic devices 10, the phenomenon that the FPC board is broken down at a welding point position may occur when the spot welding temperature and pressure are overhigh during spot welding of the FPC board and the voice coil. The dome is arranged above the welding point position of the spot welding. Consequently, the FPC board may break down the aluminum foil dome, resulting in a short circuit, which makes the voice coil and the aluminum foil dome conducted, causing scrap of the acoustic device.

If an insulating material is selected as a dome material to avoid a short circuit of the dome, the strength and weight of the dome will be affected, and furthermore, the performance of the dome is affected.

DETAILED DESCRIPTION

The present disclosure is further described below in detail with reference to the accompanying drawings FIG. 1 to FIG. 5, to make the schemes and various advantages of the present disclosure clearer. In the following embodiments, the following implementations are provided to facilitate the understanding of the content of the present disclosure more clearly and thoroughly, rather than limit the present disclosure. Words for indicating orientations such as upper, lower, left and right are only used for indicating positions of the shown structures in the corresponding accompanying drawings.

Figure 1:
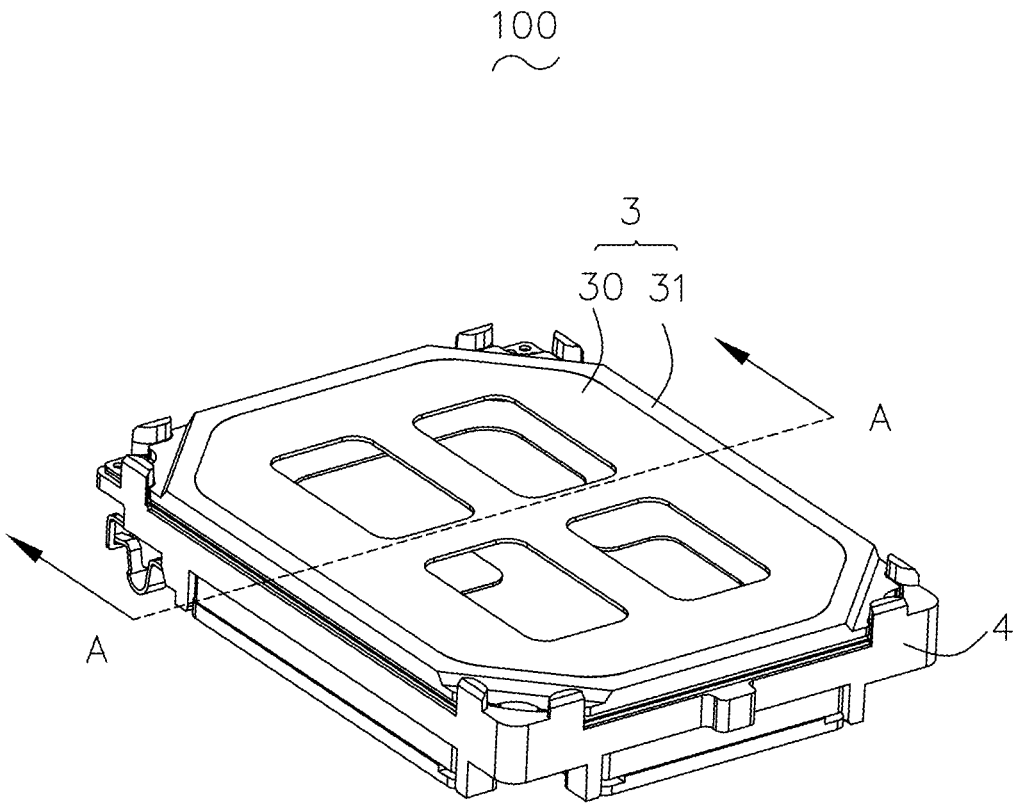
FIG. 1 is a three-dimensional view of an acoustic device according to an embodiment of the present disclosure.
Figure 2:
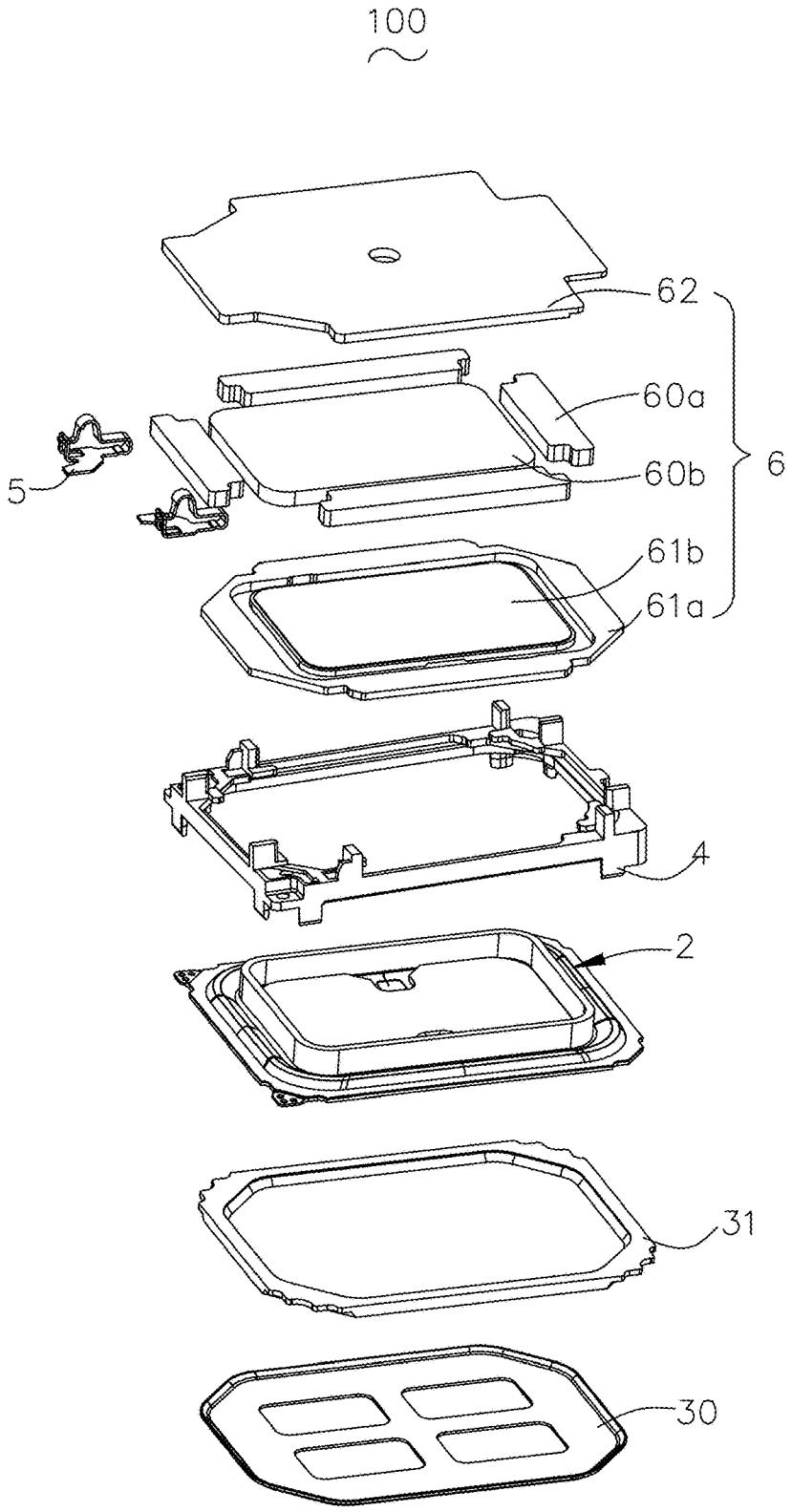
FIG. 2 is an exploded view of the acoustic device according to an embodiment of the present disclosure.
Figure 3:
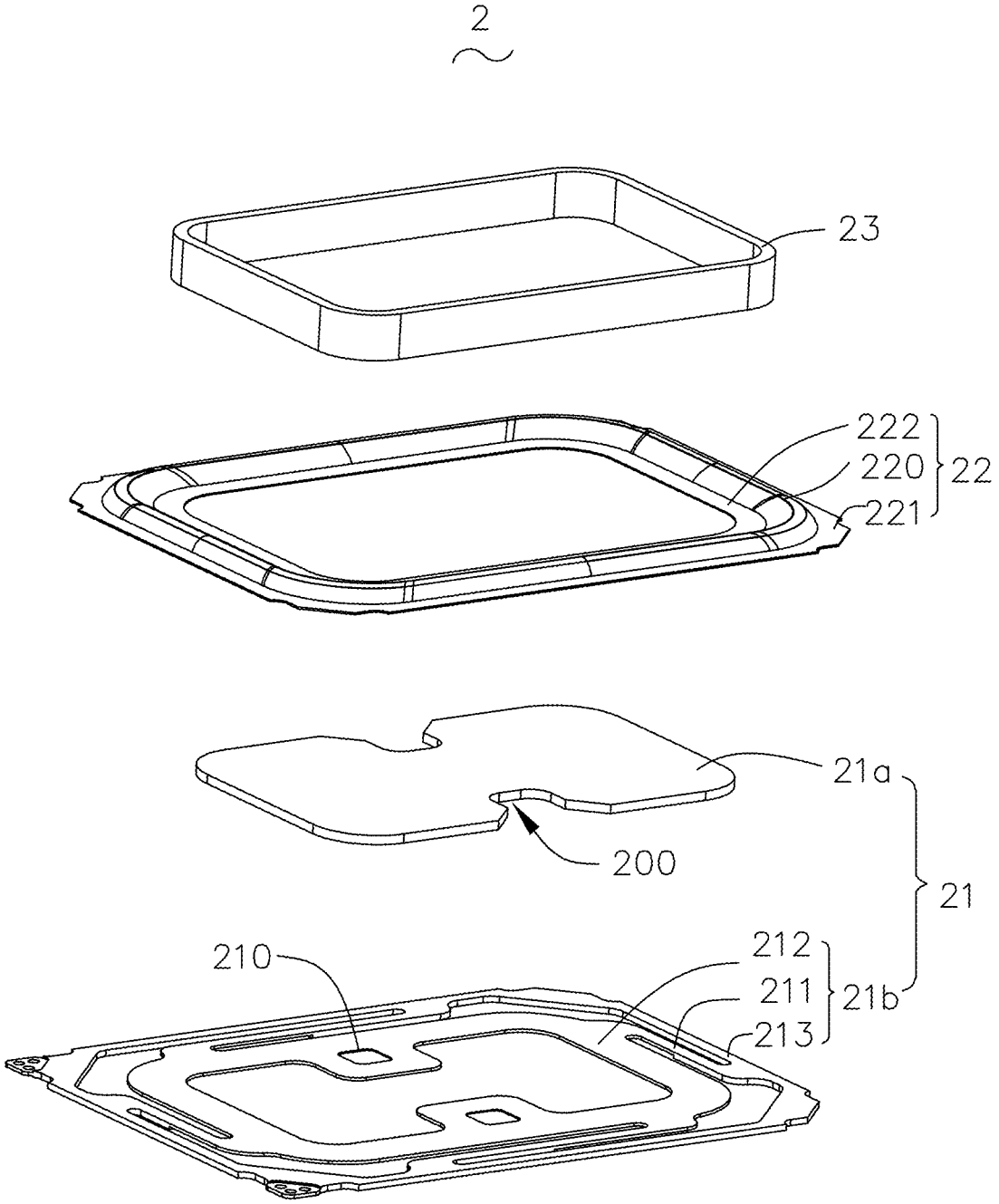
FIG. 3 is an exploded view of a vibration system according to an embodiment of the present disclosure.
Figure 4:
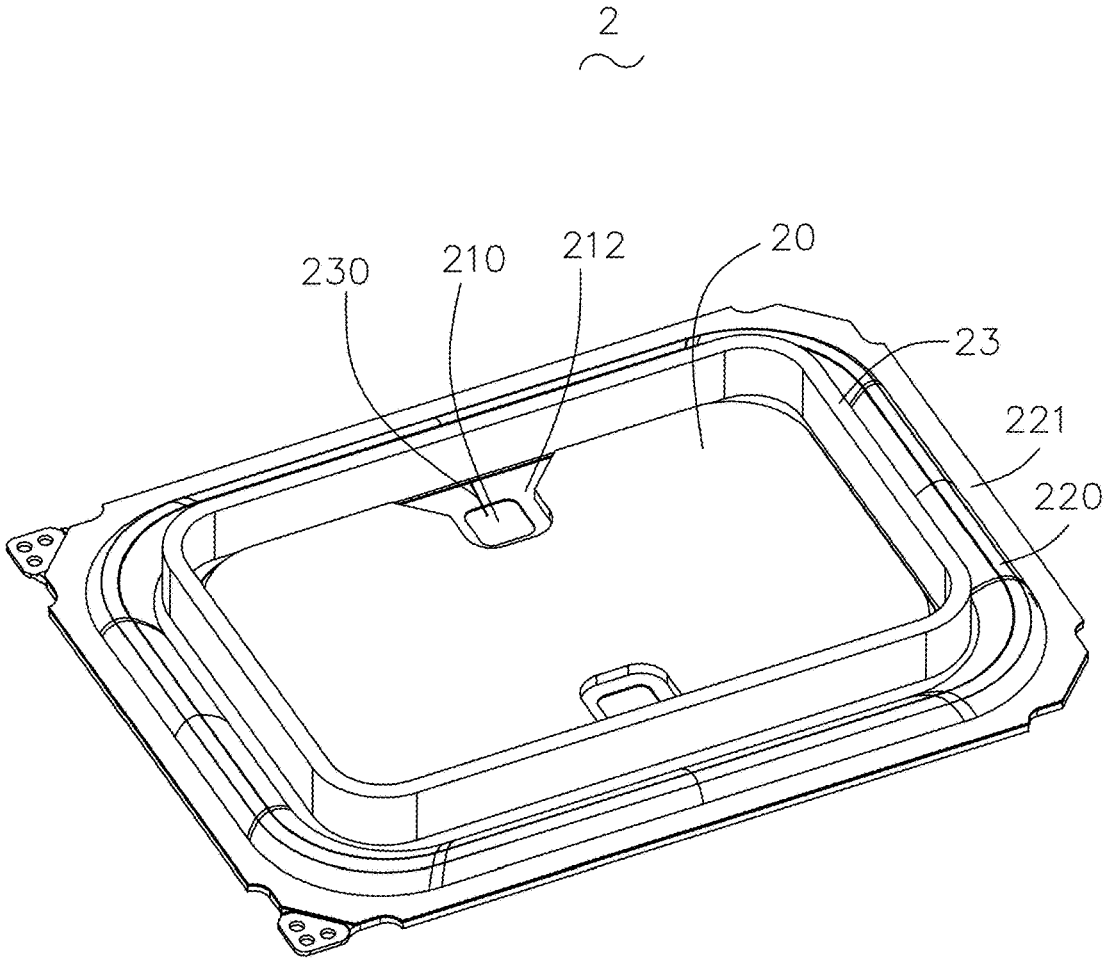
FIG. 4 is a three-dimensional view of a vibration system according to an embodiment of the present disclosure.
Figure 5:
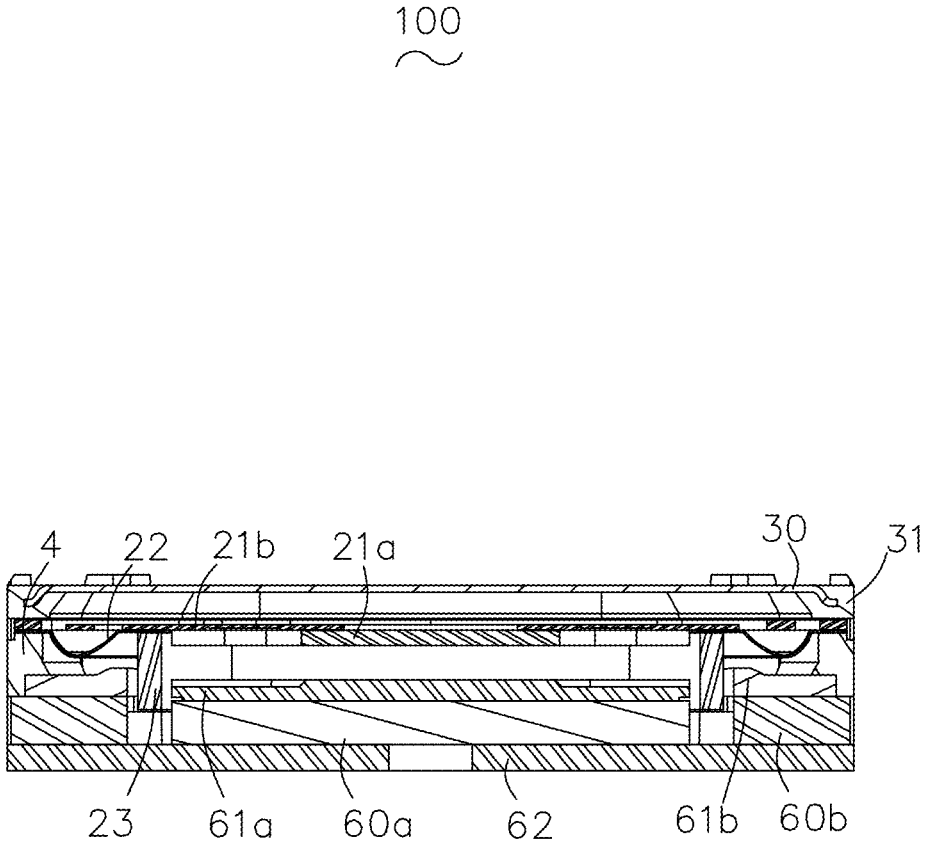
FIG. 5 is a cross-sectional view of an acoustic device along an A-A line according to an embodiment of the present disclosure.

As shown in FIG. 1, FIG. 2 and FIG. 5, the acoustic device provided by the embodiments of the present disclosure includes a frame 4 and a magnetic circuit system 6 and a vibration system 2 which are fixed to the frame 4, the magnetic circuit system 6 drives the vibration system 2 to vibrate to produce a sound, the vibration system 2 includes a vibrating diaphragm 20 and a voice coil 23 for driving the vibrating diaphragm to vibrate, and the voice coil 23 is provided with a voice coil lead 230. As shown in FIG. 3 and FIG. 4, the vibrating diaphragm 20 includes an edge 22 and a damper 21 for fixing and supporting the edge, the damper 21 includes a middle dome 21*a* and a circuit board 21*b* for fixing and supporting the middle dome, the circuit board 21*b* includes a fixing part 212 for fixing and supporting the middle dome 21*a*, a rim part 213 arranged around a periphery of the fixing part 212 and spaced apart from the fixing part 212 and a connecting arm 211 for connecting the fixing part and the rim part, the fixing part 212 is combined and fixed to an inner rim of the edge 22 and the middle dome 21*a*, the rim part 213 is combined and fixed to an outer rim of the edge 22, and the voice coil 23 is fixed to the fixing part 212 and is not in contact with the middle dome 21*a*. The edge 22 is annular and includes the inner rim 222 fixed to the fixing part 212, the outer rim 221 fixed to the rim part 213 and a bent part 220 for connecting the inner rim 222 and the outer rim 221, and the bent part 220 protrudes towards a direction away from the connecting arm 211 and is spaced apart from the connecting arm 211 to avoid the connecting arm 211. The fixing part 212 is provided with a conductive part 210 electrically connected to the voice coil lead 230, and an orthographic projection of the middle dome 21*a* on the circuit board 21*b* is not overlapped with the conductive part 210.

Herein, the circuit board 21*b* is an FPC board, and the middle dome 21*a* is a metal dome such as an aluminum foil dome. Due to the adoption of this technical scheme, the orthographic projection of the middle dome 21*a* on the circuit board 21*b* is not overlapped with the conductive part 210. Therefore, during spot welding, the problem of short circuit of the aluminum foil dome caused by the fact that the FPC board is broken down due to overhigh spot welding temperature and pressure can be avoided.

In the embodiments of the present disclosure, the middle dome 21*a* is made of an aluminum foil material or a composite using aluminum foil as a base material. Compared with a dome made of an insulating material, the middle dome 21*a* made of the aluminum foil material or the composite using aluminum foil as the base material has better strength and weight, thereby improving the quality of the acoustic device.

As shown in FIG. 1 and FIG. 2, the acoustic device 100 in the embodiments of the present disclosure further includes an upper cover 3 and a conductive terminal 5 fixed to the frame 4, where the upper cover 3 includes a bracket 31 and a cover plate 30. The magnetic circuit system 6 includes a lower clamping plate 62, an upper clamping plate and a magnet, where the upper clamping plate includes a main body 61*b* and a peripheral part 61*a*, and the magnet includes a primary magnet 60*b* and a secondary magnet 60*a*.

As shown in FIG. 3 and FIG. 4, the voice coil lead 230 is welded and fixed to the conductive part 210, and an avoiding notch 200 directly facing the conductive part is formed through the middle dome 21*a*, where the middle dome 21*a* and the voice coil 23 are arranged on a same side of the circuit board 21*b*, and the avoiding notch 200 is formed by inward recessing from the rim of the middle dome 21*a* to avoid the conductive part 210, namely a bonding pad. The middle dome 21*a* and the voice coil 23 may also be respectively arranged at two opposite sides of the circuit board 21*b*, and in this case, the avoiding notch 200 may directly penetrate through the middle dome 21*a* without recessing from the rim of the dome 21*a*.

As shown in FIG. 3, the voice coil 23 is of a runway type, and the voice coil lead 230 extends from a middle portion of a long axis of the voice coil 23 to a direction away from the connecting arm 211 and is electrically connected to the conductive part 210. In the embodiments of the present disclosure, the connecting arm 211 is an elastic arm.

The middle dome 21*a* and the voice coil 23 may be fixed to a same side of the fixing part 212 or respectively fixed to the two opposite sides of the fixing part 212. The voice coil 23 is arranged between the middle dome 21*a* and the connecting arm 211 when the middle dome 21*a* and the voice coil 23 are fixed to the same side of the fixing part 212.

The edge 22 may be arranged at the side, close to or away from the voice coil 23, of the circuit board 21*b*. The rim part 213 is sandwiched between the outer rim 221 of the edge 22 and the frame 4 when the edge 22 is fixed to the side, away from the voice coil, of the circuit board 21*b*.

In this case, the edge 22 is arranged on an upper surface of the circuit board 21*b*, and the bent part 220 protrudes towards a direction away from the connecting arm 211 to avoid the connecting arm 211. That is, the bent part 220 protrudes towards a direction away from the voice coil 23.

As shown in FIG. 5, when the edge 22 is fixed to the side, close to the voice coil 23, of the circuit board 21*b*, the outer rim 221 of the edge is sandwiched between the rim part 213 and the frame 4, the inner rim 222 of the edge is sandwiched between the voice coil 23 and the fixing part 212, and the bend part 220 protrudes towards a direction close to the voice coil 23.

Compared with the prior art, the orthographic projection of the middle dome 21*a* of the acoustic device provided by the present disclosure on the circuit board is not overlapped with the conductive part 210. Therefore, during spot welding between the circuit board and the voice coil, the problem of short circuit of the aluminum foil dome caused by the fact that the circuit board is broken down due to overhigh spot welding temperature and pressure can be avoided, and furthermore, the finished product rate of the acoustic device is increased, and the manufacturing cost of the acoustic device is reduced.

The descriptions above are only the implementations of the present disclosure, and it should be noted that a person of ordinary skill in the art can make improvements without departing from the concept of the present disclosure. However, those improvements shall fall within the protective scope of the present disclosure.

What is claimed is:

1. An acoustic device, comprising a frame and a magnetic circuit system and a vibration system which are fixed to the frame, the magnetic circuit system driving the vibration system to vibrate to produce a sound, the vibration system comprising a vibrating diaphragm and a voice coil for driving the vibrating diaphragm to vibrate, the voice coil being provided with a voice coil lead, and the vibrating diaphragm comprising an edge and a damper for fixing and supporting the edge, wherein the damper comprises a middle dome and a circuit board for fixing and supporting the middle dome, the circuit board comprises a fixing part for fixing and supporting the middle dome, a rim part arranged around a periphery of the fixing part and spaced apart from the fixing part and a connecting arm for connecting the fixing part and the rim part, the fixing part is combined and fixed to an inner rim of the edge and the middle dome, the rim part is combined and fixed to an outer rim of the edge, and the voice coil is fixed to the fixing part and is not in contact with the middle dome;

the edge is annular and comprises the inner rim fixed to the fixing part, the outer rim fixed to the rim part and a bent part for connecting the inner rim and the outer rim, the bent part protruding towards a direction away from the connecting arm to avoid the connecting arm; and the fixing part is provided with a conductive part electrically connected to the voice coil lead, and an orthographic projection of the middle dome on the circuit board is not overlapped with the conductive part.

2. The acoustic device according to claim 1, wherein the voice coil lead is welded and fixed to the conductive part, and an avoiding notch directly facing the conductive part is formed through the middle dome.

3. The acoustic device according to claim 2, wherein the avoiding notch is formed by inward recessing from a rim of the middle dome.

4. The acoustic device according to claim 3, wherein the middle dome and the voice coil are fixedly arranged on a same side of the fixing part, and the voice coil is arranged between the middle dome and the connecting arm.

5. The acoustic device according to claim 2, wherein the voice coil is of a runway type, and the voice coil lead extends from a middle portion of a long axis of the voice coil to a direction away from the connecting arm.

6. The acoustic device according to claim 2, wherein the middle dome and the voice coil are respectively fixed to two opposite sides of the fixing part.

7. The acoustic device according to claim 1, wherein the edge is fixed to the side, away from the voice coil, of the circuit board, and the rim part is sandwiched between the outer rim of the edge and the frame.

8. The acoustic device according to claim 1, wherein the edge is fixed to the side, close to the voice coil, of the circuit board, the outer rim of the edge is sandwiched between the rim part and the frame, and the inner rim of the edge is sandwiched between the voice coil and the fixing part.

9. The acoustic device according to claim 1, wherein the middle dome is a metal dome.

10. The acoustic device according to claim 1, wherein the connecting arm is an elastic arm.

* * * * *